US006427273B1

(12) United States Patent
Berke et al.

(10) Patent No.: US 6,427,273 B1
(45) Date of Patent: Aug. 6, 2002

(54) NAPPER'S HEAD REST AND ALARM

(75) Inventors: Joseph J. Berke, 3248 Interlaken, West Bloomfield, MI (US) 48323; Charles T. Michael, Troy, MI (US)

(73) Assignee: Joseph J. Berke, West Bloomfield, MI (US)

( * ) Notice: Subject to any disclaimer, the term of this patent is extended or adjusted under 35 U.S.C. 154(b) by 0 days.

(21) Appl. No.: 09/891,252

(22) Filed: Jun. 27, 2001

(51) Int. Cl.[7] ..... A47G 9/00; A47C 20/04; A47C 20/02

(52) U.S. Cl. ..... 5/657; 5/640; 5/652; 5/904; 248/118; 297/391

(58) Field of Search ..... 5/657, 652, 640, 5/639, 638, 904; 248/118, 125.8; 297/391, 392

(56) References Cited

U.S. PATENT DOCUMENTS

| | | | | | |
|---|---|---|---|---|---|
| 245,639 | A | * | 8/1881 | Lay | 5/657 |
| 933,471 | A | * | 9/1909 | Leahy | 5/640 |
| 973,957 | A | * | 10/1910 | Neff | 5/657 |
| 1,260,929 | A | * | 3/1918 | Maxcy | 5/657 |
| 1,372,989 | A | * | 3/1921 | Baker | 5/640 |
| 2,120,310 | A | * | 6/1938 | Duncan | 5/640 |
| 2,719,577 | A | * | 10/1955 | Eyman | 5/640 |
| 4,249,712 | A | * | 2/1981 | DeLong | 5/657 |
| 5,408,713 | A | * | 4/1995 | Stratton et al. | 5/657 |
| 6,081,947 | A | * | 7/2000 | Disher | 5/638 |
| 6,236,621 | B1 | * | 5/2001 | Schettino | 5/639 |

* cited by examiner

*Primary Examiner*—Alexander Grosz
(74) *Attorney, Agent, or Firm*—Alex Rhodes

(57) ABSTRACT

A head rest and alarm for dozing in a sitting position at a table or desktop. In a first aspect of the invention, the head rest and alarm are comprised of a base, a standard extending upwardly from the base and a head support attached to an upper portion of the base and an audible alarm. In the operable position, the head rest is placed on the surface of a table and a user in a sitting position rests his head in a downward facing or side facing position on the head support. The audible alarm has a timer which is selectively adjustable to set a wake-up time of the alarm. In an alternate embodiment, the head rest and alarm further comprises the options of a tape or disk player, a clock radio and earphone jack.

19 Claims, 5 Drawing Sheets

NAPPER'S HEAD REST AND ALARM

FIELD OF THE INVENTION

This invention relates to head rests and more particularly to a head rest and alarm for dozing in a sitting position at a table or desktop.

BACKGROUND OF THE INVENTION

Executives and professionals, such as physicians, attorneys and accountants, often doze at their desks during working hours. A need for a nap can arise from a lack of sleep or a physical condition, such as stress or insomnia. Napping at a desk or table has several drawbacks. One drawback is that there are no inherent provisions on a desk or table for promoting a restful sleep. Most nappers improvise by crossing their arms and placing their heads on their crossed arms. Other nappers rest their heads on objects, such as boxes or books. The surfaces of desks, tables, books and boxes may be unsanitary causing respiratory illnesses or skin irritations.

Another drawback is that desks and tables are often filled with numerous papers and objects, making it difficult to locate a clear space for a nap. Another drawback is that a limited time is available for acquiring a deep and restful sleep. Still yet another drawback is that there are no provisions to regulate sleep time or prevent oversleeping. Still yet another drawback is that pain, dysesthesias and paresthesias can occur in a napper's neck or arms, awakening a napper or diminishing the quality and quantity of sleep.

SUMMARY OF THE INVENTION

In employing the teaching of the present invention, a plurality of alternate constructions can be adopted to achieve the desired results and capabilities. In this disclosure, only several aspects of the invention are discussed. However, these aspects are intended as examples and should not be considered as limiting the scope of the invention. One feature of the invention is that the invention is ergonomic and allows for variations in anatomical structure and flexibilities of individuals. Another feature is that an alarm is provided for preventing a napper from over sleeping. Another feature is that music is available for promoting a quick and restful sleep and the time can be preset.

In a first aspect, the invention comprises a base; a slender vertical standard having a lower end portion which telescopingly engages the base; a head support pivotally attached to an upper end portion of the upright standard; and an audible alarm mounted in the base. In a second aspect, the invention further comprises a tape or disk player, a clock-radio and headphone jack mounted in the base.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating specific embodiments of the invention byway of non-limiting example only.

DETAILED DESCRIPTION OF A PREFERRED EMBODIMENT

Figure 1:
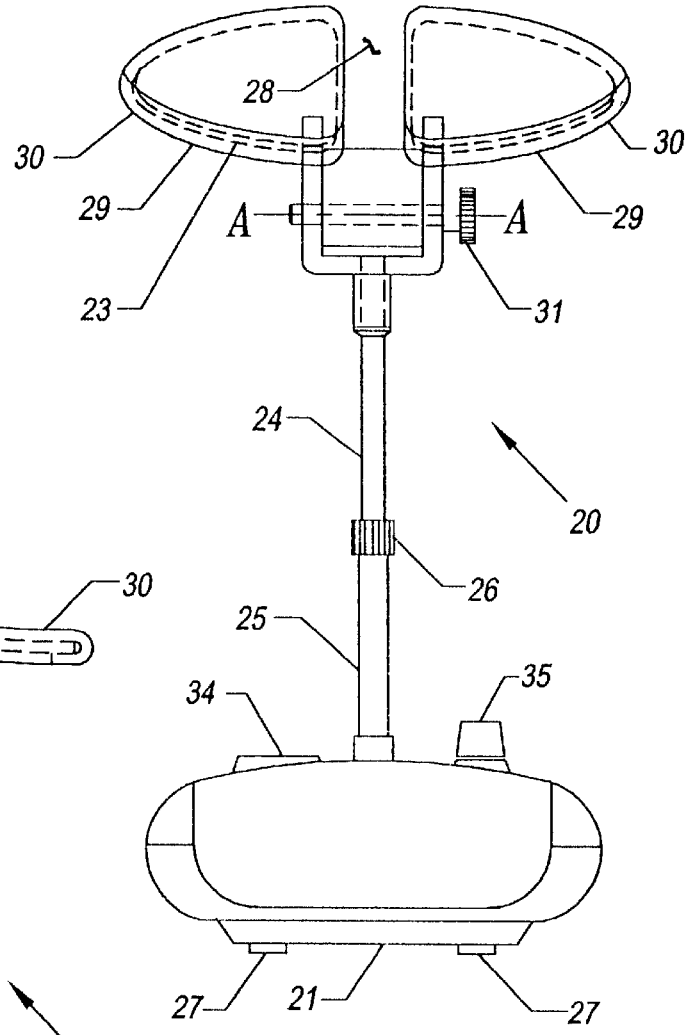
FIG. 1 is a front view of a napper's head rest according to the present invention.

Referring now to the drawings wherein like numerals designate like and corresponding parts throughout the several views, a head rest 20 is shown in FIGS. 1 through 4, inclusive, which is exemplary of the invention. When it is in use, the head rest 20 is placed on the surface of an article of furniture such as a table, desk or credenza. The head rest 20 is used to support a head in a downward facing or side facing position.

The head rest 20 is comprised of a base 21, a vertical standard 22 having a lower end portion attached to the base 21, and a head support 23 attached to an upper end portion of the standard 22. The head rest 20 is preferably an assembly of separable parts for storage in a desk drawer or for transport in a suitcase to accompany an executive or professional. The separable assembly is accomplished by telescopingly engaging the lower end portion of the standard 22 with an aperture of the base 21 and telescopingly engaging the head support 23 with the upper end portion with an aperture of the standard 22.

Figure 2:
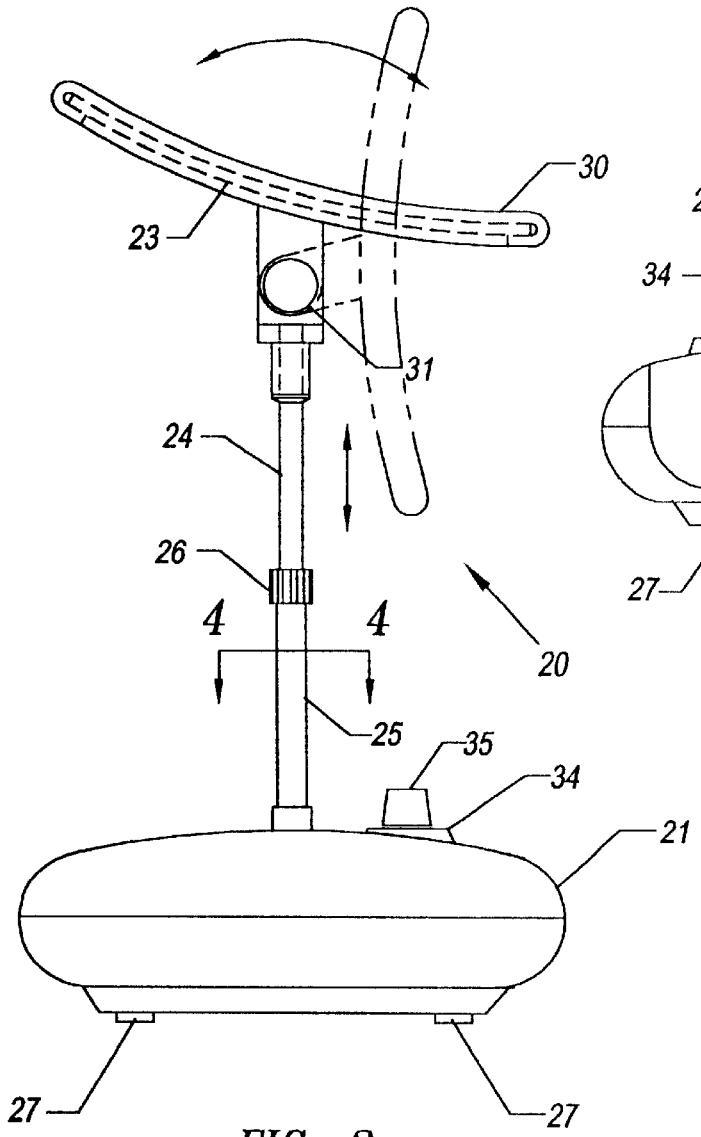
FIG. 2 is a left side view of the napper's head rest.
Figure 3:
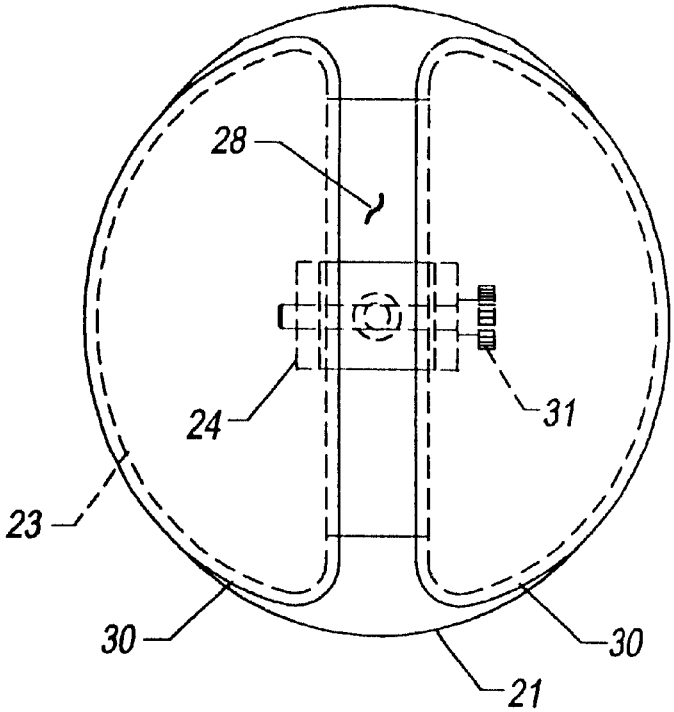
FIG. 3 is a plan view of the napper's head rest.
Figure 4:
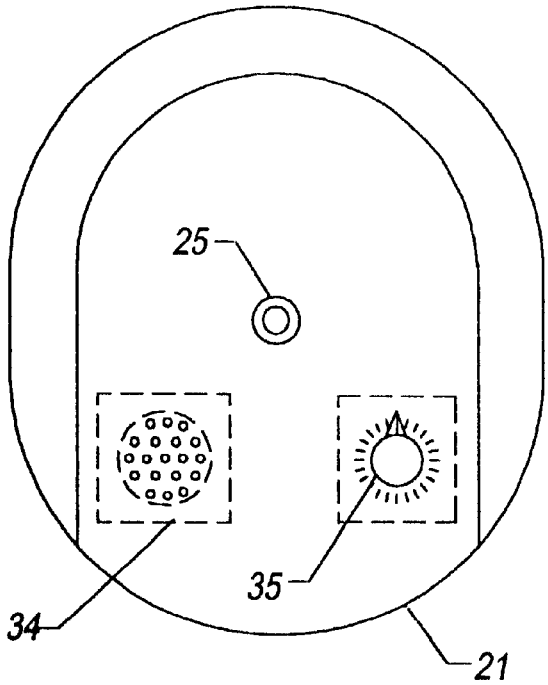
FIG. 4 is a cross-sectional view taken on the line 4—4 in FIG. 1.

The standard 22 is comprised of a slender cylindrical upper member 24 and a telescopingly engaging slender cylindrical lower member 25. A lock nut 26 or some other suitable means is provided for locking the head support 23 at a selected height. At the four corners of the base 21 are small rubber pads 27 to prevent the base 21 from sliding. With reference to FIGS. 2 and 4, the head support 23 is a bifurcated planar member with an open center portion 28 for permitting a head to be comfortably supported on the head support 23 in a downward facing position. At each half portion of the head support 23 is a removable cover 30. A small pillow can also be placed on the head support 23.

The head support 23 is pivotally attached to an upper end portion of the standard with a cross-bolt 31. The cross-bolt 31 allows a user to selectively rotate the head support 23 about a horizontal axis A—A to suit a user's needs. Mounted in the base 21 is a timer 33 and audible alarm 34. The timer 33 and alarm 34 are conventional mechanical or electronic units. The wake-up time of the alarm 34 is set by adjusting a rotary control 35 of the timer 34. The rotary control 35 is mounted on an upper surface of the base 21.

With reference to FIGS. 5 through 10, an alternate embodiment 40 is illustrated which includes several enhancements, namely, a conventional player 36 for a tape cassette or a compact disk; a clock-radio 37 and a headphone jack 38. The tape cassette or compact disk is loaded into the audio player 36 through a hinged cover 39 which is shown in an open position in FIG. 2. The clock-radio 37 and audio player 36 are conventional and include the usual type controls for setting a wake-up time, volume, broadcasting frequency, etc.

Figures 5, 6:
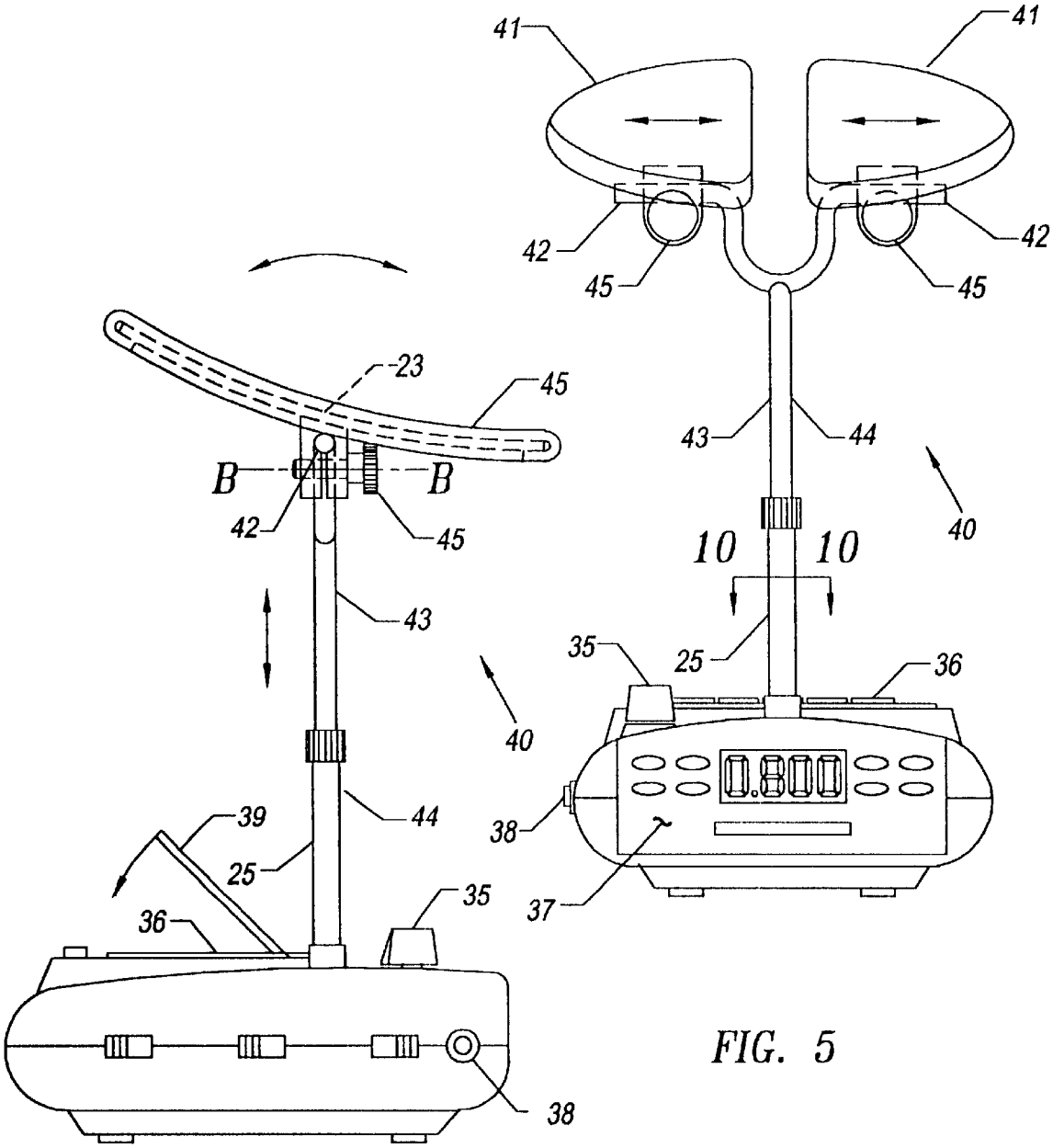
FIG. 5 is a front view of an alternate embodiment.
FIG. 6 is a left side view of the alternate embodiment.
Figure 7:
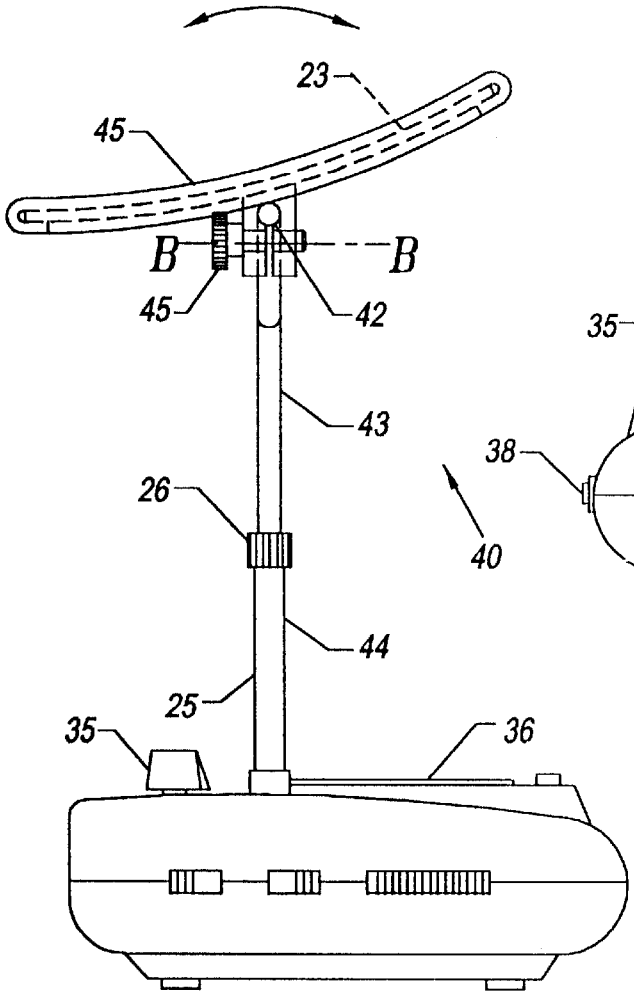
FIG. 7 is a right side view of the alternate embodiment.
Figure 8:
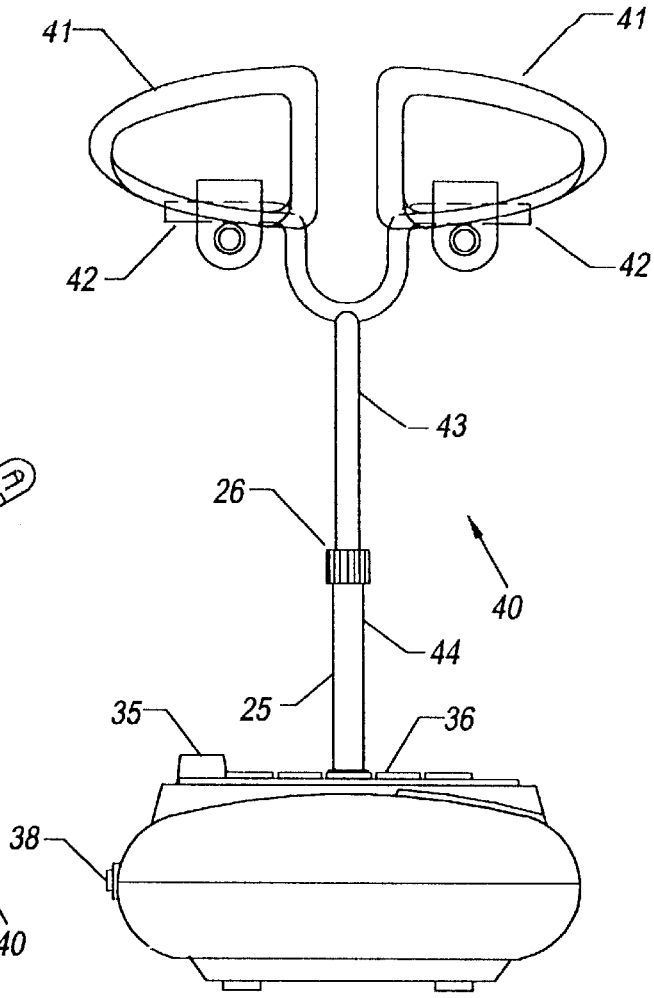
FIG. 8 is a rear view of the alternate embodiment.
Figure 9:
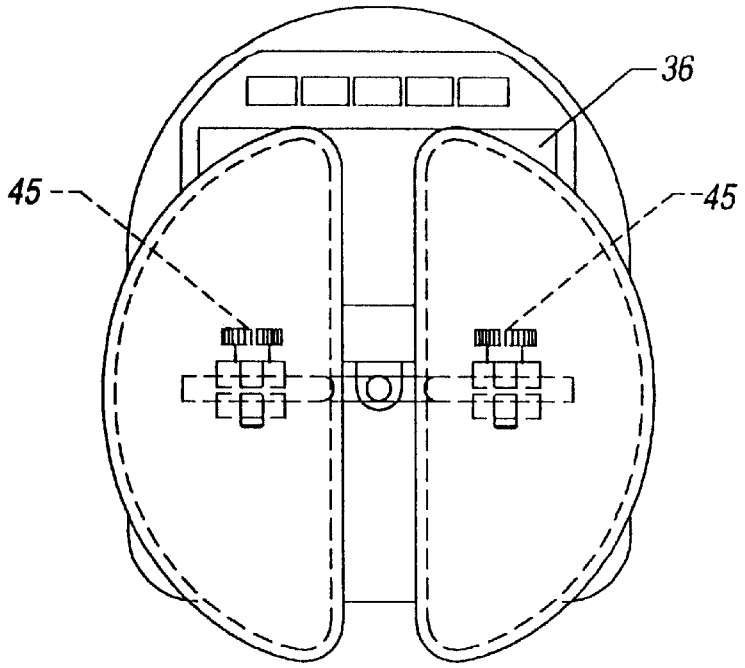
FIG. 9 is a plan view of the alternate embodiment.
Figure 10:
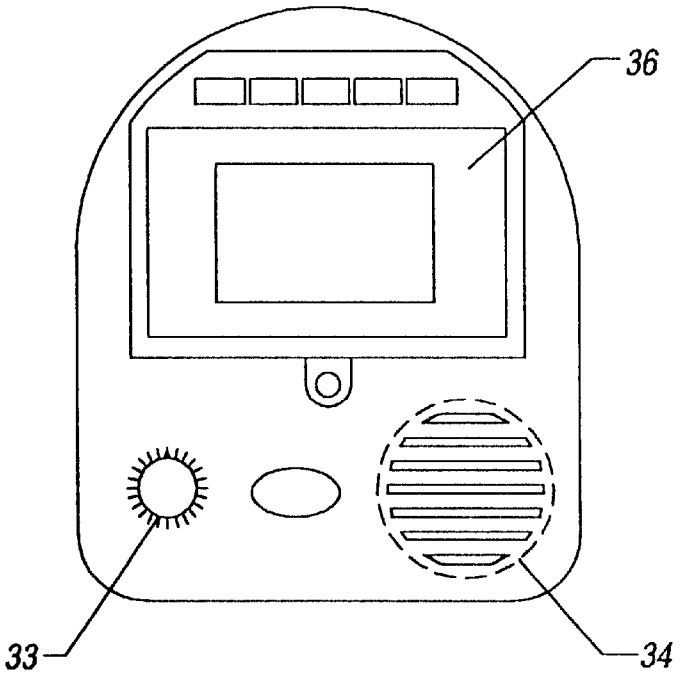
FIG. 10 is a cross-sectional view taken on the line 10—10 in FIG. 5.

Referring now to FIGS. 5 and 6, in the alternate embodiment 40, the head support 23 is comprised of two separate spaced apart members 41. The head rest members 41 are pivotally mounted on outwardly extending horizontal portions 42 of an upper member 43 of a standard 44. The lower member 25 of the standard 44 is the same as the earlier embodiment 20. The head rest members 41 are clamped to the standard with cross-bolts 45. The head support members 41 can be separately rotated about a horizontal axis B—B on the standard 44 or displaced in a lateral direction.

From the foregoing it is apparent that our invention provides numerous benefits which were heretofore unavailable. One benefit is that our head rest and alarm can be easily disassembled and folded into a compact arrangement, stored in a desk drawer or carried in a suitcase or brief. Another benefit is that it can be used on a crowded table or desk. A still further benefit is that it regulates sleep time and prevents oversleeping. Most importantly, it allows an executive or professional to refresh himself with a brief but restful sleep.

Although only two embodiments have been illustrated and described, it is obvious that other embodiments can be developed from our invention by changes, such as substitution of parts, inversion of parts, substitutions of materials, and re-arrangement of parts without departing from the spirit thereof.

We claim:

1. A head rest for dozing in a sifting position at an article of furniture comprising: a base for supporting said head rest on a surface of said article of furniture; a slender vertical standard having an end portion attached to said base; and a bifurcated head support attached to an upper portion of said standard for supporting a head in a downward facing or side facing position said bifurcated head support having a pair of spaced apart portions mounted on said vertical standard for supporting said head in said downward facing position said spaced apart portions being laterally adjustable relative to each other.

2. The head rest recited in claim 1 further comprising a pair of removable covers attached to said pair of spaced apart portions of said bifurcated members.

3. The head rest recited in claim 1 further comprising a means for reproducing an audio recording for promoting a quick and restful sleep.

4. The head rest recited in claim 3 wherein said means for reproducing an audio recording is an audio cassette tape player.

5. The head rest recited in claim 3, wherein said means for reproducing an audio recording is an audio compact diskplayer.

6. The head rest recited in claim 3 further comprising a jack for connecting a headphone.

7. The head rest recited in claim 1 wherein said bifurcated head support is pivotally mounted to said upper portion of said standard for rotation about a horizontal axis.

8. A head rest for dozing in a sitting position at an article of furniture having a supponting surface, comprising: a base for supporting said head rest on a surface of said article of furniture; a slender vertical standard having an end portion attached to said base; and a bifurcated head support attached to an upper portion of said standard for supporting a head in a downward facing or side facing position, said bifurcated support comprising a pair ofspaced apart portions each of said portions slidably mounted on said standard for selectively displacing said portions away from each other.

9. The head rest recited in claim 8 further comprising an audio tape player for reproducing a recording on a magnetic tape.

10. The head rest recited in claim 8 further comprising a compact disk player for reproducing a recording on a compact disk.

11. The head rest recited in claim 8 further comprising a means for arousing a user of said head rest from a sleep.

12. The head rest recited in claim 8 further comprising an audible alarm mounted in said base, said audible alarm having a means for selectively adjusting an activation time.

13. The head rest recited in claim 8 wherein said standard is comprising of a pair of telescopingly engaging members of adjusting a height of said head support from said surface of said furniture.

14. The head rest recited in claim 8 further comprising a clock-radio mounted in said base.

15. A method for a person dozing in a sitting position at an article of furniture comprising the steps of placing a bifurcated head support having a pair of spaced apart portions for supporting a head of said person on a surface of said article of furniture said spaced apart portions being laterally adjustable relative to each other; adjusting a height of said pair of spaced apart portions of said head support above said surface; selectively rotating said pair of spaced apart portions of said head support about a horizontal axis; placing a head of said person sitting at said article of furniture on said spaced apart portions of said head support; and activation an audio recording for promoting a deep and restful sleep.

16. The method recited in claim 15 wherein said head is placed on said head support in a downward facing position.

17. The method recited in claim 15 wherein said head is placed on said head support in a side facing position.

18. The method recited in claim 15 further comprising the step of setting a wake-up time of an audible alarm.

19. The method recited in claim 15 further comprising the step of setting the wake-up time of a clock radio.

* * * * *

UNITED STATES PATENT AND TRADEMARK OFFICE

CERTIFICATE OF CORRECTION

PATENT NO. : 6,427,273 B1
DATED : August 6, 2002
INVENTOR(S) : Joseph J. Berke and Charles T. Michael It is certified that error appears in the above-identified patent and that said Letters Patent is hereby corrected as shown below:

Column 3,
Line 25, change “sifting” to -- sitting --

Column 4,
Line 2, change “supponting” to -- supporting --
Line 8, change “ofspace” to -- of space --
Line 24, change “comprising” to -- comprised --
Line 25, change “of” to -- for --
Line 41, change “activation” to -- activating --

Signed and Sealed this

Twenty-sixth Day of November, 2002

*Attest:*

*Attesting Officer*

JAMES E. ROGAN
*Director of the United States Patent and Trademark Office*